United States Patent [19]

Kii

[11] 4,243,860

[45] Jan. 6, 1981

[54] CIRCUIT INTERRUPTER WITH PRESSURE LIMITING

[75] Inventor: Masami Kii, Amagasaki, Japan

[73] Assignee: Mitsubishi Denki Kabushiki Kaisha, Tokyo, Japan

[21] Appl. No.: 889,959

[22] Filed: Mar. 24, 1978

[30] Foreign Application Priority Data

| | | | |
|---|---|---|---|
| Mar. 24, 1977 | [JP] | Japan | 52-32911 |
| Mar. 24, 1977 | [JP] | Japan | 52-32914 |
| Mar. 24, 1977 | [JP] | Japan | 52-32924 |
| Mar. 24, 1977 | [JP] | Japan | 52-32927 |
| Mar. 24, 1977 | [JP] | Japan | 52-32930 |

[51] Int. Cl.[3] ..... H01H 33/70

[52] U.S. Cl. ..... 200/148 R; 200/148 B; 200/150 D

[58] Field of Search ..... 200/148 R, 148 A, 148 B, 200/148 C, 148 D, 148 E, 148 F, 148 G, 148 H, 148 J, 148 BV, 150 D, 150 G

[56] References Cited

U.S. PATENT DOCUMENTS

| | | | |
|---|---|---|---|
| 2,061,945 | 11/1936 | Koppelmann et al. | 200/150 G |
| 3,679,851 | 7/1972 | Latour et al. | 200/150 G |
| 4,139,752 | 2/1979 | Itai et al. | 200/148 C X |

OTHER PUBLICATIONS

Japanese Unexamined Utility Model Publication No. 29345/1972, published Dec. 4, 1972, to Iwamoto et al.

*Primary Examiner*—J. V. Truhe
*Assistant Examiner*—Morris Ginsburg
*Attorney, Agent, or Firm*—Oblon, Fisher, Spivak, McClelland & Maier

[57] ABSTRACT

A circuit breaker provided with an interrupter of the fluid blast type in which a gas in a chamber is increased in pressure by the arc energy in the chamber which holds the high pressure gas until a fluid path is made through openings provided in the course of circuit breaking operation of the breaker and blows the gas through the openings toward the arc drawn between contact members of the breaker for interrupting the arc. The interrupter comprises measures to prevent the pressure in the chamber from being excessively increased which otherwise would cause undesirable effects on arc quenching operation in the range of large arcing currents, while maintaining a proper fluid blast operation.

3 Claims, 10 Drawing Figures

CIRCUIT INTERRUPTER WITH PRESSURE LIMITING

BACKGROUND OF THE INVENTION

1. Field of the Invention

The present invention relates to a circuit breaker generally, and more particularly, to the provision of an improved interrupter for extinguishing an arc in a circuit breaker utilizing a pressurized fluid as an interrupting medium, such as sulfur hexafluoride $SF_6$ gas for example.

2. Description of the Prior Art

For better understanding of the nature and objects of the invention, reference may be had to the following description of the prior gas blast circuit breakers.

In an interrupter for use with a pressurized interrupting fluid, the fluid itself is required to have an excellent arc quenching capability without question, but also blasting the fluid toward the arc so as to dissipate arcing energy and cool down the temperature around the arc is considered to be an effective means to improve the arc quenching capability.

To furnish a strong blasting flow of fluid, a means to provide a pressure difference between the two extreme ends of the arcing space is required. In the conventional gas blast circuit breakers, this is accomplished by way of two provisions, one, a puffer type interrupter which comprises a puffer system interlocked with opening and closing operation of contact members of a circuit breaker and the other, a dual pressure type interrupter which comprises a gas compressor providing a high pressure to be discharged through valves interlocked with opening and closing operation. In these systems, however, various problems have been found as shown below. To operate the puffer system mechanically in conjunction with opening and closing operations, a considerably large actuating power is required.

The actuating power required increases with an increase in arcing currents, this in turn makes the puffer system large in size and consequently, its mechanism transmitting operating power is required to be highly rigid. During the no load period which ranges a large portion of the puffer system operation and when the interrupter is closing and opening a small current flow, the puffer system provided with a large operating capacity (for large current interruption) will operate with an excess power that drives the puffer mechanism too fast for a small current being interrupted. This tendency becomes more pronounced as the capacity of a circuit breaker increases, causing a split off of current and abnormal voltage rise. In the dual pressure type interrupter, because of its dual pressure line configuration and required equipment supporting its operation like the valves, compressor and control devices, the whole system becomes large in size and complicated.

To eliminate the disadvantages of heavy cost and complicated structure in these conventional systems, a new type gas blast circuit breaker, simple in structure and economical, has been recently developed. This circuit breaker comprises an interrupter in which an interrupting gas in a chamber is heated and resolved by the arc energy in the chamber and the increase in pressure.

The gas increased in pressure is stored in the enclosed space choked with the arc flow and as the arc current decreases, the gas will flow through openings caused by the decreased arc diameter to quench the arc. In this interrupter, however, the gas pressure in the enclosed space will excessively increase due to large arc energy in the range of large arcing currents. This pressure rise is accelerated repeatedly by the increased arc energy caused by the arc voltage pressurizing effect resulting in a rapid increase in the arc energy.

As this arc energy will heat the gas in the arcing space excessively to lower density and accelerate thermal electrolytic dissociation of it, the quenching capability is greatly lowered due to increased degree of gas ionization. In addition, contact members are subjected to excessive erosion.

SUMMARY OF THE INVENTION

It is a primary object of the present invention, therefore, to provide an improved interrupter having the advantages of high interrupting capability by comprising an interrupting chamber containing an interrupting fluid, a pair of contact members disposed therein and at least one of them movable, a pressure chamber provided in said interrupting chamber to store a pressurized gas increased in pressure by the arc drawn between said contact members, and openings for discharging said pressurized gas from said interrupting chamber so that the pressure in the pressure chamber is controlled to prevent it from being excessively increased.

Another object of this invention is to provide an interrupter comprising an interrupting chamber containing an interrupting fluid, a stationary contact member disposed therein, a movable contact member with a nozzle paired with said stationary contact member, a pressure chamber provided in the said interrupting chamber to store a pressurized gas increased in pressure by the arc drawn between said contact members, and an intermediate contact member with openings facing to and housed in the nozzle of said movable contact member so that the pressure in the pressure chamber is controlled to prevent it from being excessively increased but large enough to quench the arc drawn between the contact members.

A further object of this invention is to provide an interrupter with stable arc quenching ability when provided in larger capacity circuit breakers.

Still another object of this invention is to provide an interrupter small in size and simple in construction and having a high practical performance.

A still further object of this invention is to provide for reducing size of interrupters and decreasing deterioration of insulating materials used therein.

Another object of this invention is to provide for high interrupting performance for small interrupting currents together with increased interrupting capacity of interrupters.

BRIEF DESCRIPTION OF THE DRAWINGS

FIG. 1 is a sectional view of the principal portion of an interrupter, FIG. 2 and FIG. 3 are functional views of the same.

FIG. 4 is a sectional view of the principal portion of an interrupter, the contact members being closed, FIG. 5 and FIG. 6 are views similar to FIG. 4, the contact members being open.

FIG. 7 is a sectional view of the principal portion of an interrupter, the contact members being closed and FIG. 8 is similar to FIG. 7, but the contact members being open.

FIG. 9 and FIG. 10 show still other embodiments of this invention, in sectional views, the contact members being closed. In the figures mentioned above, the same indicating number represents an identical portion or the portion corresponding to.

DESCRIPTION OF THE PREFERRED EMBODIMENTS

Figure 1:
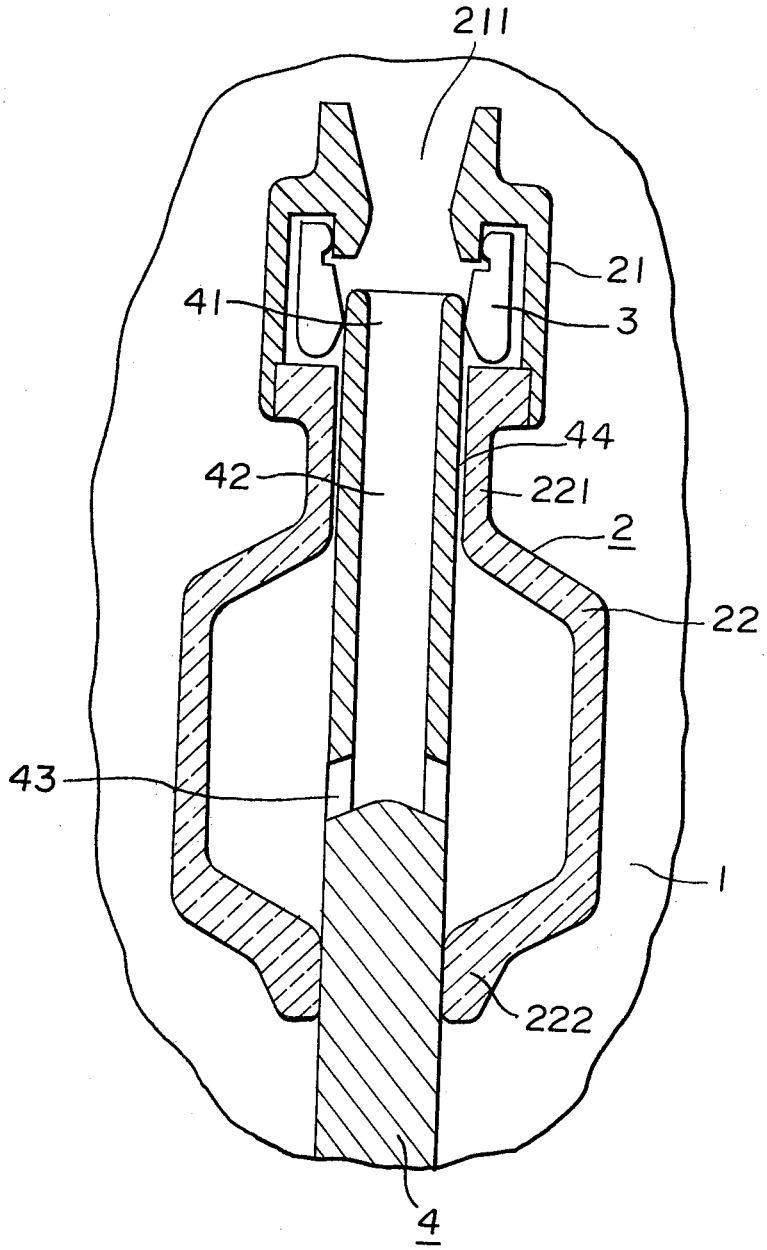
In FIG. 1 through FIG. 3 showing one embodiment of this invention.
Figure 2:
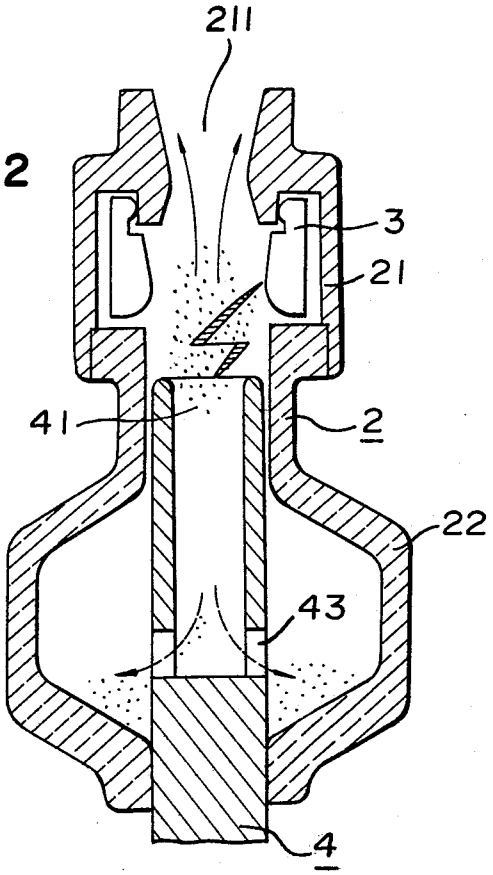
Figure 3:
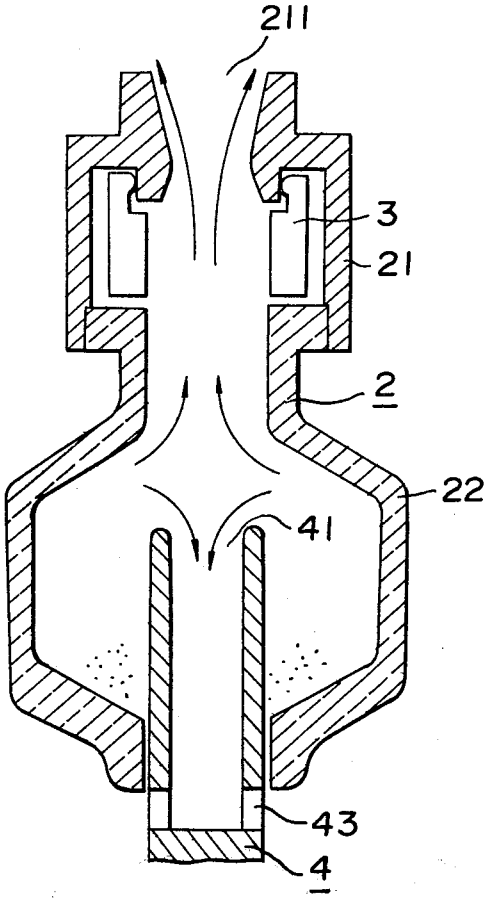

Referring to FIG. 1 through FIG. 3, (1) is a housing containing an interrupting fluid such as sulfur hexafluoride ($SF_6$) gas, (2) is an interrupting chamber disposed in said housing (1), made of a conductive material and composed of a main interrupting chamber (21) and an an opening (211). A pressure chamber (22) is made of an arc-resisting insulating material comprising diameter reduced necks (221), (222), (3) is a stationary contact member disposed in said main interrupting chamber (21), (4) is a movable contact member, partially tubular, reciprocating to and from the stationary contact member (3) within the main interrupting chamber and comprising a nozzle (41), a ventilating passage (42) and openings (43). The openings (43) of the movable contact member (4) are so constructed that they are open toward the pressure chamber (22) when the contact members are being closed. Although the movable contact member (4) is sliding along the neck (221) with the clearance (44) in between, the inner space of the neck (221) can be considered to be choked in practice.

When a suitable operating mechanism (not shown) is actuated by given tripping command signals, the movable contact member (4) interlocked with the mechanism is moved down as shown in FIG. 2 and after travelling a certain wiping distance the movable contact member (4) is separated from the stationary contact member (3). Then an arc is drawn between the both contact members which makes the gas surrounding the arc high in temperature and pressure, and a part of it flows into the housing (1) through the opening (211) as shown by the arrows in continuous line. By this flow, the arc energy is suitably dissipated so as to make temperature and pressure in the arcing space controlled moderately. The gas thus controlled is then introduced into the pressure chamber (22) to be increased in pressure through the ventilating passage (42), the nozzle (41) and the openings (43) as shown by the arrows in dotted line and kept flowing until the openings (43) are closed by the neck (222). In this state, no gas flow is completed from the arcing space into the pressure chamber (22) other than through those passages mentioned above.

At around the end of this state also, enough distance is kept between the contact members (3) and (4) for arc interruption. When the movable contact member (4) is moved down further to locate the openings (43) in the housing (1) and then the arc current reduces toward zero, the low-temperature high-pressure gas kept in the pressure chamber flows through the opening (211) and the nozzle (43), which are released from choking with the arc, driving the arc to be dissipated rapidly.

Arranged as shown above, this embodiment comprises a means to suppress the pressure in an arcing space in order to prevent the arc energy from excessively increasing and at the same time, to set the pressure increasing period or duration in the pressure chamber, which plays an important role in interrupting the arc, within the duration when the arc energy is relatively low at the commencement of the contact members separation, that is, in the stable pressure increasing period. Thus, having a required pressure for interrupting an arc positively, an interrupter with a stable arc quenching ability and capable of enlarging its capacity is provided.

Figure 4:
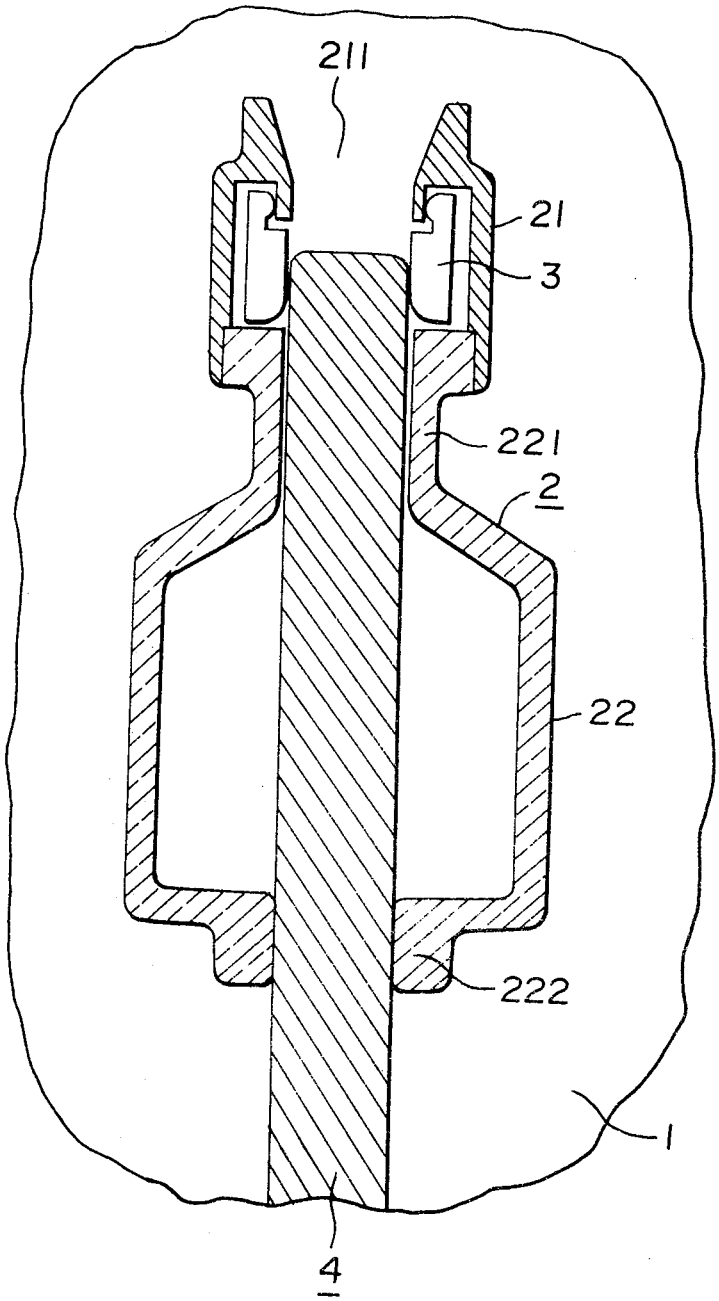
In FIG. 4 through FIG. 6 showing other embodiment of this invention.
Figure 5:
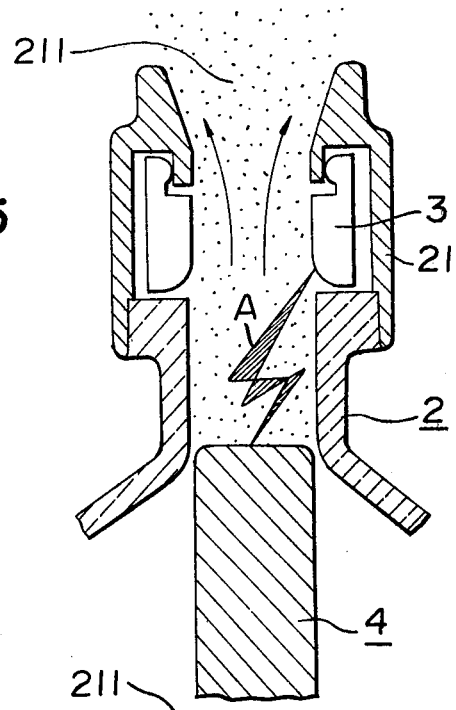
Figure 6:
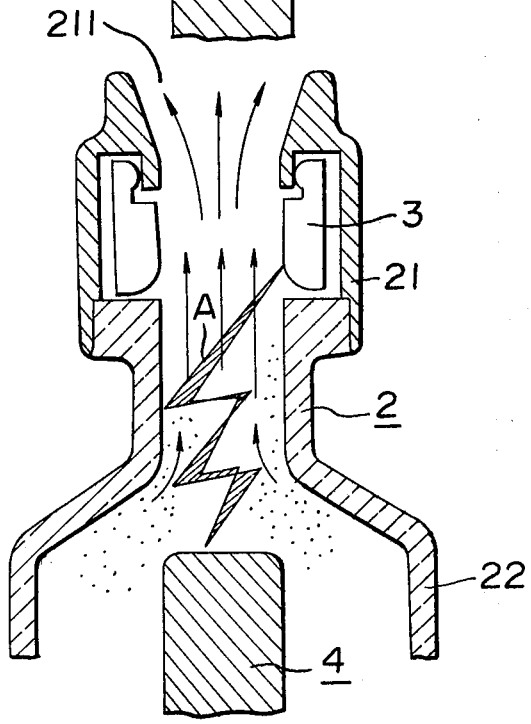

In the other embodiment of FIG. 4 through FIG. 6 similar to that of FIG. 1, a movable contact member (4) is formed like a shaft. In this arrangement, when a suitable operating mechanism (not shown) is actuated by given tripping command signals, the movable contact member (4) interlocked with the mechanism is moved down and after travelling a certain wiping distance the movable contact member (4) is separated from the stationary contact member (3). Then an arc is drawn between the contact members as shown in FIG. 5 that tends to make the fluid in the arcing space high in temperature and pressure. But as the fluid is partially discharged through the opening (211) into the housing (1), the arc energy is suitably dissipated so as to make temperature and pressure in the arcing space controlled moderately. When the movable contact member (4) is moved down further and an optimum distance is kept between the both contact members (3) and (4) for arc interruption, the arc is drawn as shown in FIG. 5 and the fluid flows as shown by the arrows, dissipating the arc energy and ionized particles.

Just before the optimum distance is obtained, the arcing space (main interrupting chamber) is connected with the pressure chamber (22) increasing the fluid pressure in the pressure chamber.

The movable contact member (4) is moved down still further when the pressure chamber is open and the arc current reduces toward zero making the opening (211) released from choking with the arc, the high-pressure fluid in the pressure chamber is dissipated to accelerate the fluid flow in the arcing space already being spread. This fluid flow clears the pressure chamber (22) of the gas and builds up insulation across the open contact members so as to quench the arc rapidly (See FIG. 6).

For a circuit that tends to have a recovery voltage across the contact members after interruption, this provision shows a remarkable performance. Arranged as shown above, this embodiment comprises a means to suppress the pressure in an arcing space in order to prevent the arc energy from excessively increasing and to select appropriate period and duration for increasing the arcing space pressure moderately with a minimum arc energy.

Thus, an interrupter with high performance which is of simple and small construction is provided.

Figure 7:
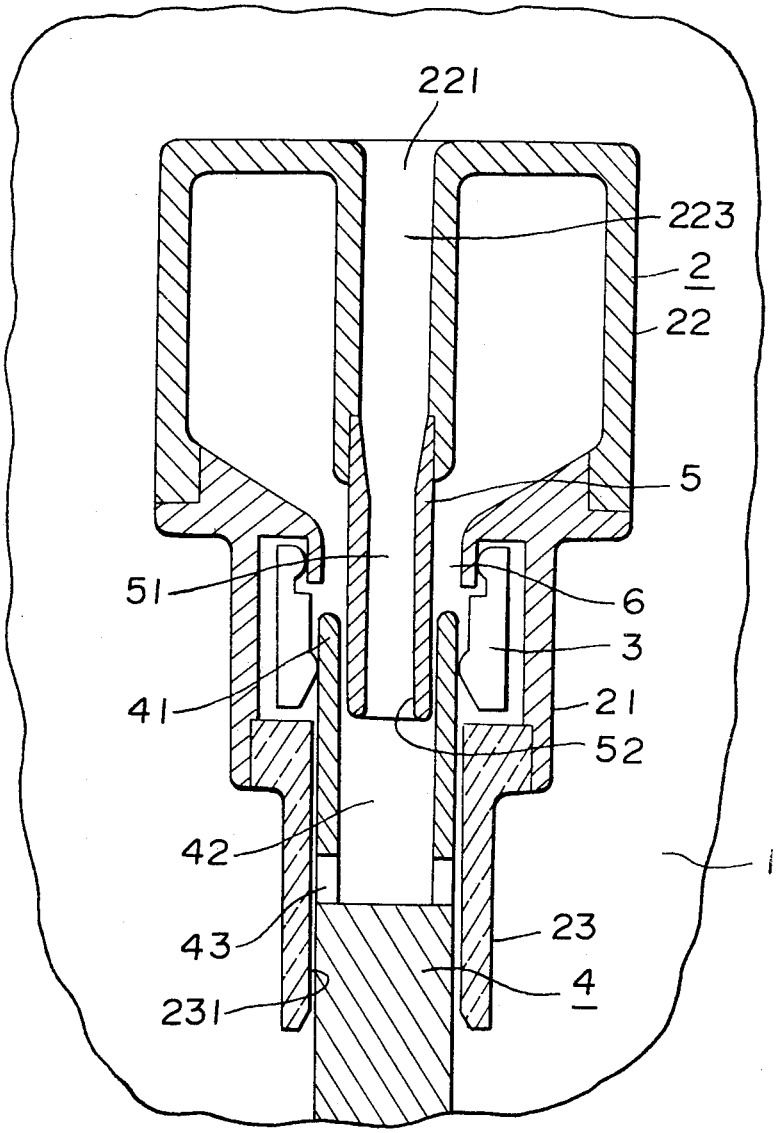
In FIG. 7 and FIG. 8 showing still other embodiment of this invention.
Figure 8:
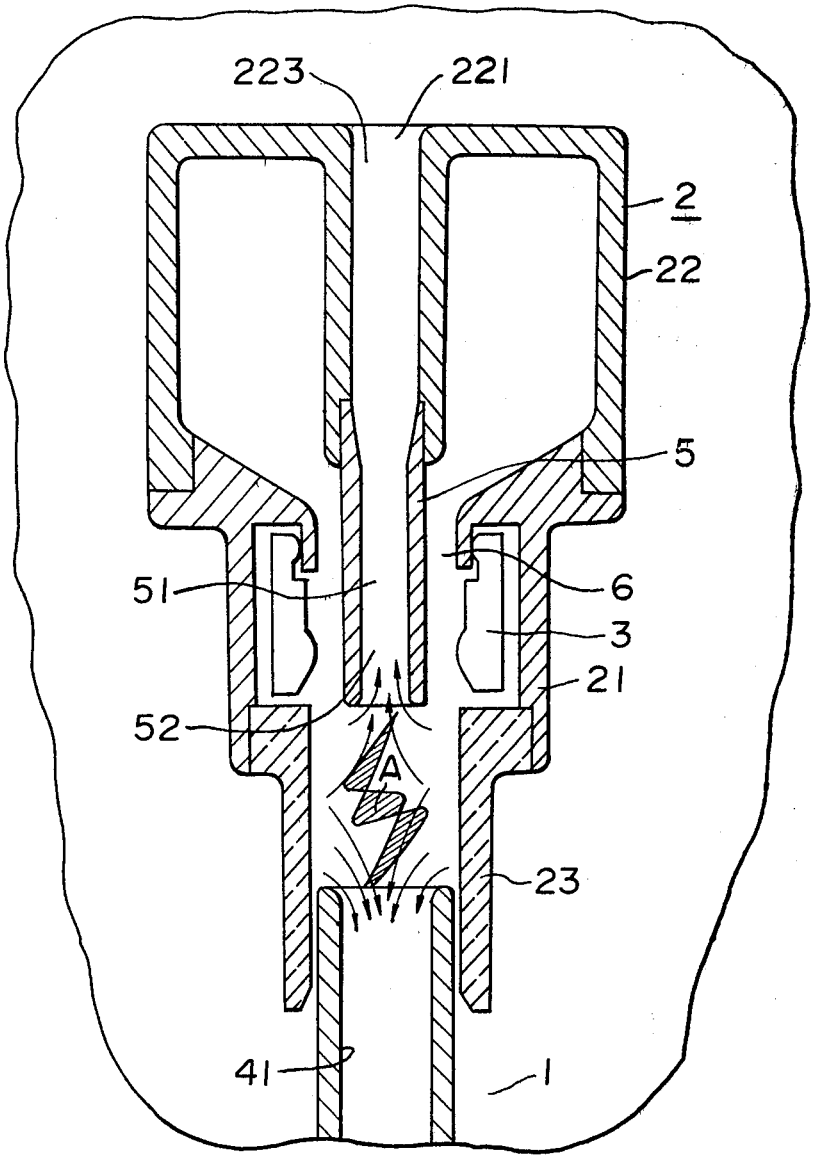

In the still other embodiment of FIG. 7 and FIG. 8, (2) is an interrupting chamber comprising a main interrupting chamber (21), a pressure chamber (22) and a flow guide (23). The pressure chamber (22) is made of a conductive material and provided with a connecting passage (223) for external space in the center together with its opening (221). The flow guide (23) is made of an arc-resisting insulating material, provided with a passage (231) through which a movable contact member (4) is disposed, and connected to the lower end of the main interrupting chamber (21) enclosing a stationary contact member (3). (5) is an arc contact member, which is conductive, provided with a passage (51) forming a nozzle (52), connected to the passage (223) of the pressure chamber (22), and inserted into the nozzle (41) of the movable contact member (4).

When the arc contact (5) is inserted into the movable contact member (4), the pressure chamber (22) is practically closed.

In this arrangement, when a suitable operating mechanism (not shown) is actuated by given tripping command signals, the movable contact member (4) interlocked with the mechanism is moved down and the movable contact member (4) is separated from the stationary contact member (3).

An arc is then drawn between the both contact members. This arc is moved to the arc contact (5) when the movable contact member (4) is slightly displaced and the arc drawn between the stationary contact member (3) and the arc contact (5) is stretched as the movable contact member (4) is moved further down. As the arc thus spread (A) chokes the nozzles (41) and (52) by its inner pressure, the pressure in the pressure chamber (22) is increased through a passage (6) when the high-temperature fluid in the arcing space is ejected with high velocity through the nozzles (41) and (52) as shown by the arrows in FIG. 8. As this fluid is driven to the roots of the arc, the highest in temperature, enclosing the roots and is introduced into a housing (1) through these nozzles, the residual energy in the arcing space is decreased so that temperature rise is suppressed and ionic density is decreased.

During the time this action takes place however, the pressure increase in the pressure chamber is still continued due to small amount mass flow from the nozzles (41) and (52).

In the course of this action the arc current decreases as time goes by and rapid temperature and pressure drops are brought about by the arc energy decrease.

The high pressure fluid in the pressure chamber continues to discharge high-temperature and ionized gas through the nozzles with high velocity until the arc is interrupted and even after that there is a circulation of fluid replacing the arcing space gas with a new fluid thereby an interrupter shows high performance for a heavy duty interrupting operation where high recovery voltage is expected between the contact members after quenching the arc.

Arranged as shown above, this embodiment comprises a means to discharge energy in the arcing space during arc interrupting operation thereby the temperature of ejected fluid is leveled and the maximum temperature of it is lowered down.

With this provision, the damage of a flash-over between a high potential line part and ground or between contact members after interruption can be reduced.

Therefore, reducing the size of interrupters and decreasing deterioration of insulating materials used therein can be provided.

Figure 9:
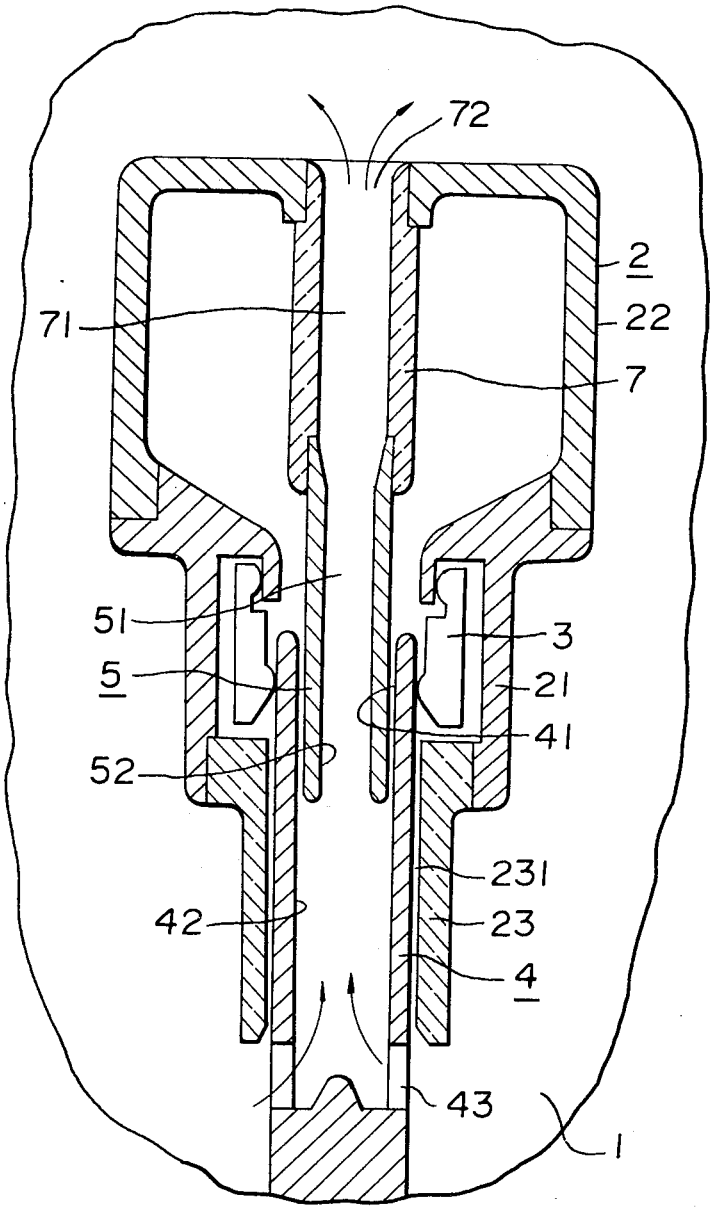

In the still other embodiment of FIG. 9, (7) is a supporting pipe made of an insulating material and fixed to a pressure chamber (22), having a passage (71) connected to the outer housing and an opening (72), and is holding an intermediate contact member (5).

In this structure, the pressure chamber (22) is practically sealed while the end of the nozzle (41) of the movable contact member (4) is completely separated from the end of the nozzle (52) of the intermediate contact member (5).

Other than this, this embodiment is similar to that of FIG. 7. In this arrangement, when a suitable operating mechanism (not shown) is actuated by given tripping command signals, the movable contact member (4) interlocked with the mechanism is moved down and the movable contact member (4) is separated from the stationary contact member (3). An arc is then drawn between the contact members and enclosed within a space formed by the intermediate contact member (5). The pressure in the closed pressure chamber (22) is then increased effectively by the arc. The movable contact member (4) is moved down further and until the nozzle (41) is cleared of sealing by the intermediate contact member (5), and enough pressure for quenching the arc is stored in the pressure chamber (22). As the degree of pressure rise in the pressure chamber is determined by the length of time during which the pressure chamber (22) is sealed, a desired value can be selected. especially when interrupting small currents, and enough pressure can be provided.

The movable contact member is then further moved down and when the nozzle (41) is separated from the end of the intermediate contact member (5) completely, the pressure chamber (22) is released from the closed state. But as long as the arc current flows, the pressure in the pressure chamber (22) is still increased and at the same time a part of the pressure provided by the arc energy is introduced to the outside (housing) through the nozzles (41) and (52). After this period, when the arc current passes its peak value and turns to decrease, the gas temperature in the arcing space is rapidly dropped making the inner pressure of the arc decreased, then in turn, the pressure chamber (22) is released from the closed state. At the same time, the high-pressure gas in the pressure chamber is discharged through the nozzles (41) and (52) by way of the arcing space.

This discharging gas ejects ionized particles at and around the roots of the arc replacing the arcing space fluid with low-temperature gas and interrupts the arc.

In this arrangement, enclosing of the pressure chamber (22) is formed near the contact point of the contact members (3) and (4). Therefore, above-mentioned performance is provided even when the opening (43) is always made open and since the contact point is directly cooled by the fluid flow from the opening (43) to (72) through the nozzle (52) as shown by the arrows in continuous line, the rating current is increased. This embodiment comprises a means to discharge the fluid in the interrupting chamber into the housing through the intermediate contact member when the stationary and movable contact members are separated further than specified.

By this provision, high interrupting efficiency is expected when interrupting small currents thereby an increased interrupting capacity and an improved interrupting efficiency can be provided.

Figure 10:
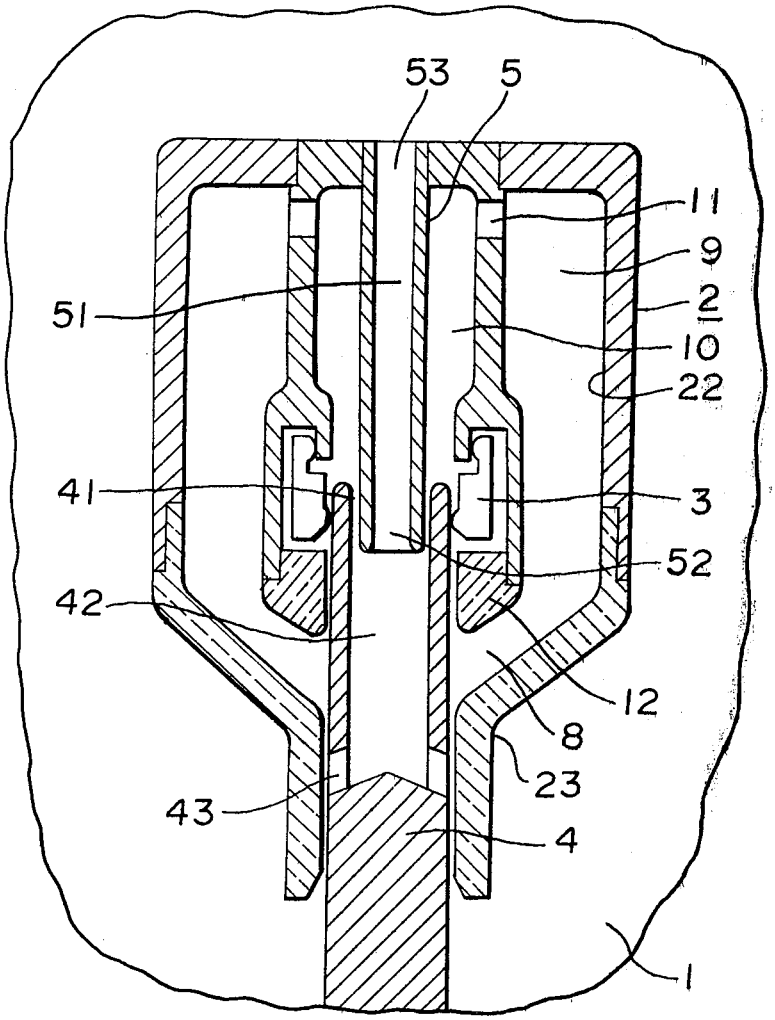

In the still other embodiment of FIG. 10, (2) is an interrupting chamber comprising a C-shape pressure chamber (22) and a flow guide (23). The pressure chamber (22) is the source of a fluid for interrupting the arc, has the proper capacity required, is composed of cylindrical chambers, (9) and (10), and is connected to the arcing space through a passage (8). As the passage (8) is always closed by a movable contact member (4), the chamber (9) is increased in pressure effectively by the interrupting fluid introduced from the pressure boosting chamber (10) through a passage (11). The chamber (9), carrying an insulating housing connected together, contains the movable contact member and a stationary contact member (3) disposed to provide make and break operation of a circuit. (5) is an arc contact having a nozzle in the center and disposed in alignment with the stationary contact member (3).

The arc contact (5) is so arranged that it is protruded into the nozzle (41) of the movable contact member (4) when closed. (53) is an opening of the arc contact (5) for the outer housing.

The nozzle (52) is opened in the arcing space and used for discharging high-temperature and high-pressure fluid at the arcing center to the housing (1) during pressure increasing period of the pressure chamber (22) in order to prevent it from excessive pressure increase caused by large arc currents.

When the movable contact member (4) is moved down and the contact members are separated wide enough for arc interrupting operation, the high-pressure fluid in the pressure chamber (22) continues to discharge high-temperature gas at the arcing center and replace it with a fresh, low-temperature and high-pressure gas thereby an interrupter shows high performance for a heavy duty interrupting operation where high recovery voltage is expected after quenching the arc.

In this arrangement, when a suitable operating mechanism (not shown) is actuated by given tripping command signals, the movable contact member (4) interlocked with the mechanism is moved down and the movable contact member (4) is separated from the stationary contact member (3) after travelling a certain wiping distance. Then an arc is drawn between the contact members that makes the fluid in the pressure boosting chamber (10) high in temperature and pressure rapidly. As the pressure difference between the pressure boosting chamber (10) and the chamber (9) makes a fluid flow through the passage (11), the pressure in the chamber increases corresponding to the pressure rise in the pressure boosting chamber (10).

When the movable contact member (4) is moved down further, pressure rise operation in the chamber (9) continues until the nozzle (41) is released to the opening (8) thereby the pressure in the chamber (9) is kept high. As the fluid in the pressure boosting chamber is discharged through the nozzle (52) having a proper diameter, the pressure in the pressure boosting chamber (10) is maintained balanced, so that the required pressure for interrupting the arc is always maintained. When the movable contact member (4) is moved down further, the nozzle (41) is released to the passage (8), and at the same time, the opening (43) is released to the chamber (1).

As the arc current decreases, the nozzles (41) and (52) are cleared of choking by the arc current, then the fluid in the arcing space is ejected through the nozzles (41) and (52) thereby the pressure of it drops rapidly. The high-pressure and low-temperature fluid contained in the chamber (9) is then fed to the arcing space interrupting the arc and is flowing therein until the chamber (9) is leveled with the housing (1) in pressure.

This embodiment comprises a means to provide an interrupter easy to operate and excellent in performance for a wide current range.

What is claimed as new and desired to be secured by letters patent of the United States is:

1. A circuit interrupter comprising:
a housing containing an interrupting fluid;
an interrupting chamber in said housing;
a fixed contact in said interrupting chamber;
an elongated movable contact normally located with one end contacting said fixed contact in said interrupting chamber, the remainder of said movable contact extending away from said interrupting chamber in one directional sense with respect to said interrupting chamber;
a pressure chamber disposed adjacent to said interrupting chamber in said one directional sense, said pressure chamber normally surrounding a portion of said movable contact, said pressure chamber communicating with said interrupting chamber through a first passage, said first passage being normally closed by said movable contact;
a second passage communicating said interrupting chamber with said housing in a directional sense opposite said one directional sense; and
means for moving said movable contact away from said fixed contact in said one directional sense, whereby an arc is formed between said contacts and a portion of said interrupting fluid is pressurized and passes out from said interrupting chamber through said second passage.

2. The circuit interrupter of claim 1 wherein said movable contact includes a bore defining a first nozzle at said one end and at least one second nozzle in a portion of said movable contact normally located in said pressure chamber.

3. A circuit interrupter comprising:
a housing containing an interrupting fluid;
an interrupting chamber in said housing;
a fixed contact in said interrupting chamber;
an elongated movable contact, having a bore and defining a nozzle at one end, normally located with said one end contacting said fixed contact in said interrupting chamber, the remainder of said movable contact extending away from said interrupting chamber in one directional sense with respect to said interrupting chamber;
a pressure chamber disposed adjacent to and communicating with said interrupting chamber in a directional sense opposite said one directional sense;
a hollow fixed contact member extending from said pressure chamber to said interrupting chamber, said hollow fixed contact member extending into said nozzle and communicating said bore with said housing; and
means for moving said movable contact in said one directional sense away from said fixed contact and said hollow fixed contact member, whereby an arc is formed between said contacts and a portion of said interrupting fluid is pressurized and passes out from said interrupting chamber through said hollow fixed contact member.

* * * * *